US011807985B2

(12) United States Patent
Yamada

(10) Patent No.: US 11,807,985 B2
(45) Date of Patent: Nov. 7, 2023

(54) WEB TRANSPORTATION APPARATUS AND FIBER ARTICLE PRODUCING APPARATUS

(71) Applicant: SEIKO EPSON CORPORATION, Tokyo (JP)

(72) Inventor: Kentaro Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/929,770

(22) Filed: Sep. 6, 2022

(65) Prior Publication Data

US 2023/0075175 A1 Mar. 9, 2023

(30) Foreign Application Priority Data

Sep. 7, 2021 (JP) ..... 2021-145244

(51) Int. Cl.

| | |
|---|---|
| ***D21F 1/22*** | (2006.01) |
| ***D21B 1/08*** | (2006.01) |
| ***D21F 9/00*** | (2006.01) |
| ***D21F 2/00*** | (2006.01) |

(52) U.S. Cl.

CPC ..... *D21F 1/22* (2013.01); *D21B 1/08* (2013.01); *D21F 2/00* (2013.01); *D21F 9/00* (2013.01)

(58) Field of Classification Search

CPC ..... D21F 1/22; D21F 2/00; D21F 9/00; D21F 1/32; D21B 1/08; B65G 45/18; B65G 45/26; B65H 5/021; B65H 2601/261; D21C 5/02; D21H 27/42; D01D 10/0445

See application file for complete search history.

(56) References Cited

U.S. PATENT DOCUMENTS

2006/0225990 A1* 10/2006 Yoshizako ..... B65G 45/12 198/499
2019/0145023 A1* 5/2019 Higuchi ..... B65G 45/18 19/65 A

FOREIGN PATENT DOCUMENTS

JP 2019-085264 A 6/2019

* cited by examiner

*Primary Examiner* — Eric Hug
*Assistant Examiner* — Matthew M Eslami
(74) *Attorney, Agent, or Firm* — Global IP Counselors, LLP

(57) ABSTRACT

A web transportation apparatus includes a mesh belt configured to be rotated to transport a web formed of a dry deposited material containing fibers and a striking member configured to strike a return section of the mesh belt to remove the material attached to the mesh belt. The striking member includes a striking bar and a striking lever. The striking bar is reciprocated to strike the mesh belt.

9 Claims, 5 Drawing Sheets

WEB TRANSPORTATION APPARATUS AND FIBER ARTICLE PRODUCING APPARATUS

The present application is based on, and claims priority from JP Application Serial Number 2021-145244, filed Sep. 7, 2021, the disclosure of which is hereby incorporated by reference herein in its entirety.

BACKGROUND

1. Technical Field

The present disclosure relates to a web transportation apparatus and a fiber article producing apparatus.

2. Related Art

A conventionally known transportation apparatuses transports a web containing fibers on a mesh belt. For example, JP-A-2019-85264 discloses a transportation apparatus including protrusions. The protrusions are intended to remove fibers attached to the openings of the mesh belt.

However, it is difficult for the transportation apparatus described in JP-A-2019-85264 to have an improvement in the ability to remove fibers from the mesh belt. Specifically described, the protrusions enter the openings of the mesh belt to push out the fibers, and thus fibers are readily attached to the protrusions. This does not allow easy removal of fibers from the mesh belt and allows fibers on the protrusions to be attached to the mesh belt again in some cases. There is a demand for a web transportation apparatus that has an improvement in the ability to remove fibers or the like from the mesh belt and a fiber article producing apparatus.

SUMMARY

According to an aspect of the present disclosure, a web transportation apparatus includes a mesh belt configured to be rotated to transport a web formed of a dry deposited material containing fibers and a striking member configured to strike a return section of the mesh belt to remove the material attached to the mesh belt. The striking member includes a striking bar and a striking lever. The striking bar is reciprocated to strike the mesh belt.

According to another aspect of the present disclosure, a fiber article producing apparatus includes a deposition unit configured to dry deposit a material containing fibers, a web transportation unit including a mesh belt on which the material is deposited and configured to transport a web formed of the deposited material on the mesh belt, and a shaping unit configured to press the web transferred from the mesh belt. The web transportation unit includes a striking member including a striking bar and a striking lever to strike a return section of the mesh belt to remove the material attached to the mesh belt. The striking bar is reciprocated to strike the mesh belt.

DESCRIPTION OF EXEMPLARY EMBODIMENTS

Figure 1:
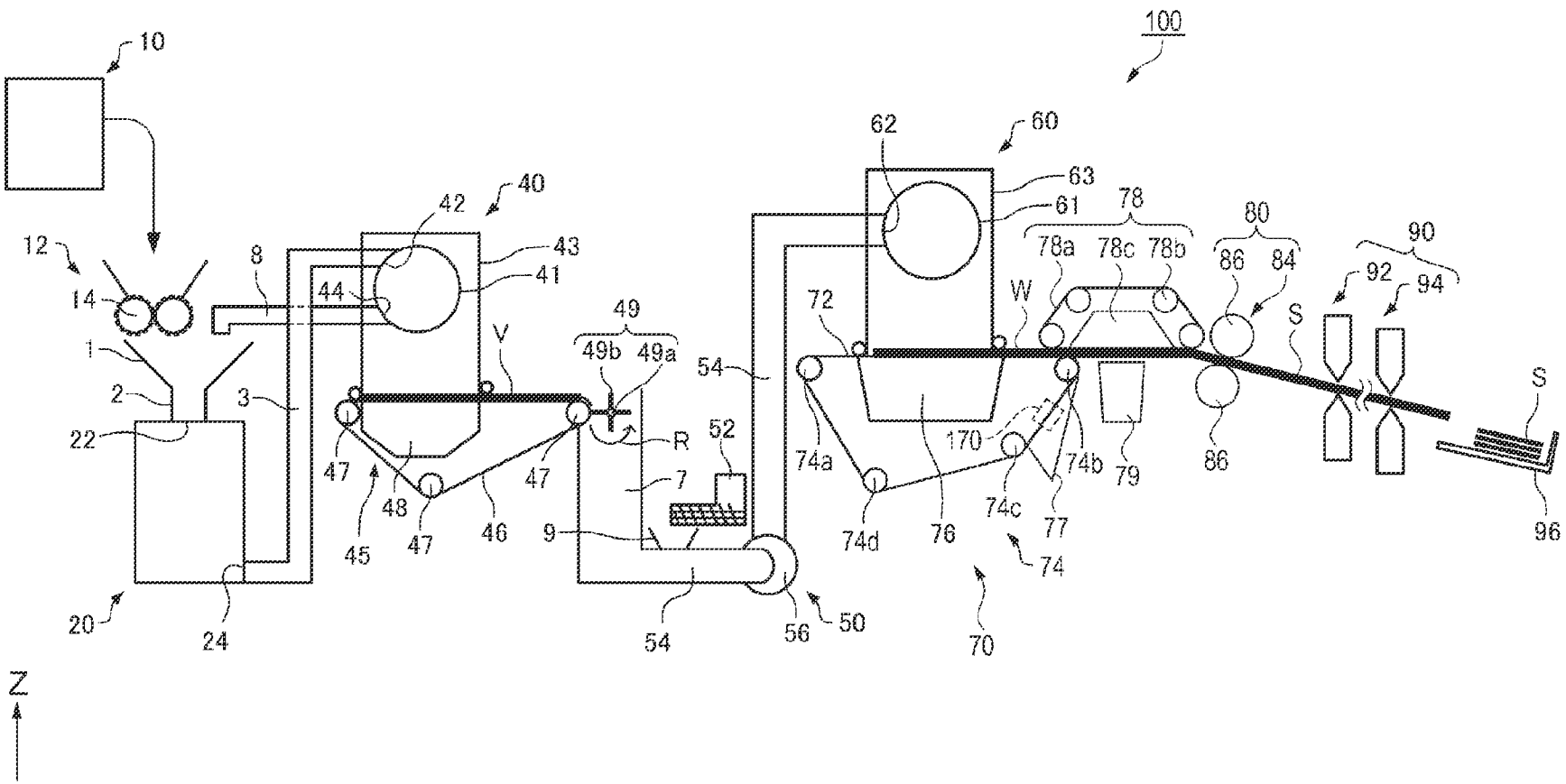
FIG. 1 is a schematic outline view illustrating a fiber article producing apparatus according to a first embodiment.

The following embodiments describe examples of a fiber article producing apparatus that produces a sheet-like fiber article containing fibers. Hereinafter, a fiber article producing apparatus and a web transportation apparatus according to this embodiment will be described with reference to the drawings.

In the drawings, the XYZ axes are indicated as orthogonal coordinate axes as needed. Directions indicated by arrows are positive directions, and directions opposite the positive directions are negative directions. The Z axis is an imaginary axis extending in the vertical direction. The +Z direction corresponds to an upward direction and the −Z direction corresponds to a downward direction. The −Z direction is a direction of gravitational force.

Furthermore, in the fiber article producing apparatus and the web transportation apparatus, a forward side in a transportation direction in which the material and a fiber article travel may be referred to as downstream, and a side opposite the forward side in the transportation direction may be referred to as upstream.

1. First Embodiment

As illustrated in FIG. 1, a fiber article producing apparatus 100 according to this embodiment includes, in this order from upstream to downstream, a feeder 10, a coarse crusher 12, a defibrator 20, a sorter 40, a first web forming unit 45, a rotor 49, a mixer 50, a deposition unit 60, a web transportation apparatus 70, a conveyance unit 78, a shaping unit 80, and a cutting unit 90. Although not illustrated, the fiber article producing apparatus 100 further includes a controller that collectively controls operations of these components. The fiber article producing apparatus 100 produces a fiber article S in the form of cut sheets.

The web transportation apparatus 70 is an example of a web transportation unit of the fiber article producing apparatus 100 according to the present disclosure. The web transportation apparatus 70 forms a second web, which will be described later. In the following description, the second web may be simply referred to as a web.

The feeder 10 feeds a material to the coarse crusher 12. The feeder 10, for example, continuously and automatically feeds the material into the coarse crusher 12. The material to be fed to the coarse crusher 12 contains fibers and constitutes the fiber article S.

Various fibrous material may be used as the fibers. Examples of the fibrous material include a natural fiber and a chemical fiber. Examples of the natural fiber include animal fibers, such as wool and silk, and plant fibers, such as cotton, flax, ramie, hemp, jute, abaca, sisal, palm, and cellulose derived from kenaf, rushes, conifers, and broadleaf trees.

The fibrous material may be virgin pulp or recycled fibers, such as used paper and used cloth. The recycled fibers may contain impurities or a component contained before recycling, for example. The fibrous material may be defibrated substances obtained through dry defibration of used paper or a pulp sheet. The fibrous material may be surface treated. The fibrous material may be formed of one kind of materials or may be a blended material containing two or more kinds of materials.

The length of an independent single fiber in the longitudinal direction is, for example, not less than 1 μm and not greater than 5 mm. The length is preferably not less than 2 μm and not greater than 3 mm, and more preferably not less than 3 μm and not greater than 3 mm. The length in the above range makes the formation of the fiber article S easy and improves the strength of the fiber article.

The content of fibers in the fiber article S is, for example, not less than 50.0% by mass and not greater than 99.9% by mass, preferably not less than 60.0% by mass and not greater than 99.0% by mass, more preferably not less than 70.0% by mass and not greater than 99.0% by mass, of the total mass of the fiber article S. The content in the above range makes the formation of the fiber article S easy and improves the strength of the fiber article. The content is adjusted by changing a blending ratio of constituents forming a mixture, which will be described later.

In this embodiment, the fibrous material is used paper that is printed copier paper. The coarse crusher 12 shreds the used paper, which is a material fed by the feeder 10, in an atmosphere such as in the air into fine pieces. The fine piece is a square a few cm on a side, for example.

The coarse crusher 12 is a shredder having coarsely crushing blades 14. The used paper is chopped into fine pieces by the coarsely crushing blades 14. The fine pieces of the used paper are collected into a hopper 1 and carried to the defibrator 20 through a tube 2.

The defibrator 20 defibrates fine pieces carried from the coarse crusher 12. Here, the term "defibrating" means separating fibers bonded together into individual fibers. Furthermore, the defibrator 20 separates resins attached to the fibers, coloring materials, such as ink and toner, and additives from the fibers.

The fine pieces of the used paper are defibrated by the defibrator 20 into defibrated substances. In some cases, the defibrated substances contain, in addition to the defibrated fibers, resin particles, coloring materials, and additives, such as a sizing agent and a paper strength enhancer, which were separated from the fibers by the defibration. The fibers of the defibrated substances may be independent fibers that are not tangled together or may form a mass including tangled fibers.

The defibrator 20 performs dry defibration. Dry defibration means defibration in an atmosphere such as in the air, not in a liquid. The defibrator 20 may be an impeller mill, for example.

The defibrator 20 generates an airflow to suction fine pieces of the used paper and to eject the defibrated substances. This enables the defibrator 20 to suction fine pieces on the airflow generated by itself to the inside through the inlet 22 and perform a defibrating process on the fine pieces and to carry the defibrated substances on the airflow to the outlet 24. The defibrated substances are carried from the outlet 24 to the sorter 40 through a tube 3. The airflow that carries the defibrated substances from the defibrator 20 to the sorter 40 is not limited to one generated by the defibrator 20. The airflow that carries the defibrated substances may be generated by an airflow generator, such as a blower.

The sorter 40 receives the defibrated substances from the defibrator 20 through an inlet 42. The defibrated substances in the sorter 40 are sorted depending on the length of the fibers contained in the defibrated substances. The sorter 40 includes a drum 41 and a housing 43 accommodating the drum 41.

The drum 41 is a cylindrical sieve that is rotated by a motor (not illustrated). The side surface of the cylindrical drum 41 has a net, which functions as a sieve. Examples of the net include a wiring net, an expanded metal formed by stretching a metal plate having slits, and a perforated metal formed by stamping a metal plate to have holes.

The cylindrical drum 41 is rotated about a rotation shaft (not illustrated) to sort the defibrated substances in the drum 41. Specifically described, the drum 41 separates the defibrated substances into first sorted substances and second sorted substances. The first sorted substances include fibers and particles smaller than the sieve openings. The second sorted substances include fibers and non-defibrated pieces, and lumps larger than the sieve openings. The first sorted substances pass through the sieve openings of the drum 41. The second sorted substances do not pass through the sieve openings of the drum 41.

The first sorted substances are discharged from the drum 41 and deposited on the first web forming unit 45. The second sorted substances are sent back through an outlet 44 in communication with the drum 41 to the defibrator 20 through a tube 8 and the tube 2. The second sorted substances are defibrated by the defibrator 20 again.

The first web forming unit 45 forms a first web V from the first sorted substances. The first web forming unit 45 includes a perforated belt 46, support rollers 47, and a suctioning mechanism 48.

The suctioning mechanism 48 is located below the drum 41. The suctioning mechanism 48 suctions air from below the sorter 40 through the holes of the perforated belt 46. Thus, the first sorted substances discharged from the drum 41 are suctioned downward and deposited on the upper surface of the perforated belt 46. A known suctioning device such as a blower may be used as the suctioning mechanism 48.

The holes of the perforated belt 46 allow air to pass therethrough but do not readily allow the first sorted substances to pass therethrough. The perforated belt 46 is an endless belt and is wound on the three support rollers 47. Rotation of the support rollers 47 moves an upper surface of the perforated belt 46 downstream. In other words, the perforated belt 46 rotates in a clockwise direction in a side view of FIG. 1.

When the suctioning mechanism 48 suctions air containing the first sorted substances from the sorter 40, the first sorted substances are deposited on the upper surface of the perforated belt 46 by suction. Since the perforated belt 46 is moved by the support rollers 47, the first sorted substances are continuously deposited to form the first web V. The first web V contains a relatively high proportion of air, and thus is soft and swollen. The first web V is carried downstream to the rotor 49 along with the movement of the perforated belt 46. The rotor 49 is located near the downstream one of turning positions of the perforated belt 46.

The rotor 49 separates the first web V. The rotor 49 includes a base 49*a* and multiple projections 49*b*. The projections 49*b* protrude radially from the base 49*a* in side view. The four projections 49*b* are each a plate-like member. The four projections 49*b* are spaced apart from each other at an equal interval in side view. Rotation of the base 49*a* in a rotation direction R rotates the four projections 49*b* in the rotation direction R about the base 49*a*. The four projections 49*b* come in contact with the first web V while rotating, separating the first web V. The first web V separated by the rotor 49 is transported downstream through a tube 7 to the mixer 50.

The mixer 50 mixes a binder and the separated first web V, or the first sorted substances, together to make a mixture. The mixer 50 includes a binder feeder 52, a tube 54, and a blower 56. The tube 54 is in communication with the upstream tube 7. The binder feeder 52 feeds a binder to the tube 54 through a hopper 9. The binder feeder 52 may be a screw feeder or a disc feeder.

The binder may be starch or dextrin, for example. The starch is a polymer of α-glucose molecules bound together by glycosidic linkages. The starch may have either a linear molecule structure or a branched molecule structure.

The starch may be plant-derived starch. The starch may be derived from grains, such as corn, wheat, and rice, beans, such as broad beans, mung beans, and red beans, tubers and roots, such as potatoes, sweet potatoes, and tapiocas, wild grass, such as dogtooth violet, bracken, and kudzu, and palms, such as sago palm.

The starch may be processed starch. Examples of the processed starch include acetylated distarch adipate, acetylated starch, oxidized starch, starch sodium octenyl succinate, hydroxypropyl starch, hydroxypropyl distarch phosphate, monostarch phosphate, phosphated distarch phosphate, urea phosphorylated esterified starch, sodium starch glycolate, or high-amylose cornstarch. Dextrin, or modified starch may be processed or modified starch.

The use of starch or dextrin as the binder increases the strength of the fiber article S when the web (described later) is moisturized and then pressed and heated. If the strength of the fiber article S is sufficiently high, the binder does not need to be added to the first sorted substance, and thus the binder feeder 52 may be eliminated.

The content of the binder in the fiber article S is, for example, not less than 0.1% by mass and not greater than 50.0% by mass, preferably not less than 1.0% by mass and not greater than 40.0% by mass, and more preferably not less than 1.0% by mass and not greater than 30.0% by mass, of the total mass of the fiber article S. The content is adjusted by changing the amount of additives fed from the binder feeder 52.

In addition to the binder, additives, such as a coloring material for coloring the fiber article S, a coagulation inhibitor for preventing coagulation of fibers or coagulation of an adhesive, and a flame retardant for making the fiber article S more resistant to fire may be suitably added to the mixture prepared using the binder feeder 52.

The blower 56 generates an airflow in the tube 54. The airflow mixes the first sorted substance transported from the tube 7 to the tube 54 and the binder together to form a mixture and carries the mixture downstream. The mechanism for mixing the first sorted substance and the binder is not limited to the blower 56. The mechanism may be a high-speed rotating blade or a V-type mixer that uses rotation of a vessel. Then, the mixture is carried from the tube 54 to the deposition unit 60.

The deposition unit 60 allows the mixture, which is a material containing fibers, to enter a drum 61 through an inlet 62 and to be dry deposited on the mesh belt 72. The deposition unit 60 includes the drum 61 and a housing 63 accommodating the drum 61. The web transportation apparatus 70 including the mesh belt 72 and a suctioning mechanism 76 is disposed below the deposition unit 60. The suctioning mechanism 76 faces the drum 61 with the mesh belt 72 therebetween in the vertical direction.

The drum 61 is a cylindrical sieve that is rotated by a motor (not illustrated). The side surface of the cylindrical drum 61 has a net, which functions as a sieve. The drum 61 has the similar configuration as the drum 41 of the sorter 40. The drum 61 allows fibers and particles of a binder smaller than the sieve openings to pass therethrough from inside to outside. The drum 61 loosens the tangled fibers contained in the mixture and disperses the disentangled fibers into the air in the housing 63.

The sieve of the drum 61 does not need to have a function of sorting out large fibers contained in the mixture, for example. In other words, the drum 61 may discharge all the mixture into the housing 63 after loosening the fibers in the mixture. The mixture dispersed in the air in the housing 63 is deposited on the upper surface of the mesh belt 72 by gravity and by suction of the suctioning mechanism 76.

The web transportation apparatus 70 includes the mesh belt 72, the suctioning mechanism 76, a striking member 170, and a collection portion 77. The web transportation apparatus 70 uses the suctioning mechanism 76 to accelerate deposition of the mixture, which is a material containing fibers, on the mesh belt 72. The web transportation apparatus 70 rotates and transports a web W, which is a second web formed of a dry deposited mixture, downstream. Furthermore, the web transportation apparatus 70 removes a mixture, or a residue of the web W, from the mesh belt 72 by using the striking member 170. The residue of the web W detached from the mesh belt 72 is collected into the collection portion 77.

The suctioning mechanism 76 is located below the drum 61. The suctioning mechanism 76 suctions air in the housing 63 through holes of the mesh belt 72. Thus, the mixture discharged from the drum 61 is suctioned downward together with the air and deposited on the upper surface of the mesh belt 72. The suctioning mechanism 76 may be a known suctioning device, such as a blower.

The holes of the mesh belt 72 allow air to pass therethrough but does not readily allow the fibers and the binder in the mixture to pass therethrough. The mesh belt 72 is an endless belt and is wound on four support rollers 74*a*, 74*b*, 74*c*, and 74*d*. In the following description, the four support rollers 74*a*, 74*b*, 74*c*, and 74*d* are collectively referred to as support rollers 74 in some cases.

Rotation of the support rollers 74 moves the upper surface of the mesh belt 72 downstream. In other words, the mesh belt 72 rotates in a clockwise direction in a side view of FIG. 1. Here, a section of the mesh belt 72 extending from the support roller 74*a* to the support roller 74*b* is called a transportation section, and a section of the mesh belt 72 extending from the support roller 74*b* to the support roller 74*a* through the support rollers 74*c* and 74*d* is called a return section. The support roller 74*b* is a starting point of the return section of the mesh belt 72.

The suctioning mechanism 76 suctions air containing the mixture in a dispersed state from the housing 63 through the holes of the mesh belt 72. This allows the mixture to be deposited on the upper surface of the mesh belt 72 by suction. Since the mesh belt 72 is rotated by the support rollers 74, the mixture is continuously deposited to form the web W. The web W contains a relatively high proportion of air, and thus is soft and swollen. The web W is transported downstream to the conveyance unit 78 by rotation of the mesh belt 72.

The striking member 170 and the collection portion 77 are located between the support roller 74*b* and the support roller 74*c*. The web transportation apparatus 70 including the striking member 170 and the collection portion 77 will be described in detail later.

The conveyance unit 78 detaches the web W from the upper surface of the mesh belt 72 and carries the web W toward the shaping unit 80. The conveyance unit 78 is located above the transportation path of the web W and located slightly upstream of the starting point of the return section of the mesh belt 72. An upstream portion of the conveyance unit 78 and the transportation section of the mesh belt 72 partly overlap in the vertical direction.

The conveyance unit 78 includes a conveyance belt 78*a*, four rollers 78*b*, and a suctioning mechanism 78*c*. The conveyance belt 78*a* have holes that allows passage of air. The conveyance belt 78*a* is wound on the four rollers 78*b*. Rotation of the four rollers 78*b* rotates the conveyance belt 78*a* in a counterclockwise direction in FIG. 1.

The suctioning mechanism 78*c* faces the transportation path of the web W in the vertical direction with the conveyance belt 78*a* therebetween. The suctioning mechanism 78*c* includes a blower. An upward airflow is generated on the transportation path of the web W by the suction power of the blower of the suctioning mechanism 78*c*.

The airflow generated by the suctioning mechanism 78*c* detaches the web W from the downstream end portion of the transportation section of the mesh belt 72. The web W detached from the mesh belt 72 is carried by the conveyance belt 78*a* toward the shaping unit 80 while being attached to the lower surface of the conveyance belt 78*a* by suction.

The web W carried by the conveyance belt 78*a* may be humidified. Specifically described, a humidifier 79 may be disposed below the transportation path of the web W, for example. The humidifier 79 may spray a mist of water to the web W to humidify the web W. The humidifier 79 may be a known spray such as a sprayer. Humidification of the web W increases the strength of the fiber article S when the binder such as starch is used as described above. Furthermore, since the web W is humidified from below, droplets of water from the spray do not drip and attach to the web W. Furthermore, the web W is humidified from a surface opposite the contact surface between the conveyance belt 78*a* and the web W, reducing the possibility that the web W will attach to the conveyance belt 78*a*.

The water content of the humidified web W is preferably not greater than 40% by mass of the total mass of the web W. This enables the above-described advantages to be achieved and reduces the water used in spraying.

The shaping unit 80 presses the web W transferred from the mesh belt 72 onto the conveyance belt 78*a*. The shaping unit 80 includes a heating and pressurizing portion 84 that heats and pressurizes the web W. The fiber article producing apparatus 100 includes two heating rollers 86 as the heating and pressurizing portion 84. The two heating rollers 86 each include a built-in electric heater to heat the surface of the roller.

The web W continuously passed through a space between the two heating rollers 86 is pressed while being heated. This reduces the air in the soft web W, which contains a relatively high proportion of air, and produces a fiber article S in the form of continuous paper in which the fibers are bonded together by the binder. The fiber article S in the form of continuous paper is carried to the cutting unit 90. The configuration of the heating and pressurizing portion 84 is not limited to the configuration described above.

The cutting unit 90 cuts the fiber article S in the form of continuous paper into cut sheets. The cutting unit 90 includes a first cutter 92 and a second cutter 94. The first cutter 92 cuts the fiber article S in a direction intersecting the transportation direction of the fiber article S. Thus, the fiber article S in the form of continuous paper is cut into almost cut sheets. The second cutter 94 cuts the fiber article S in the transportation direction of the fiber article S. Thus, the planar shape of the fiber article S is trimmed. In the first cutter 92 and the second cutter 94, the cutting positions of the fiber article S in the form of continuous paper are adjusted according to the shape of cut sheets of the fiber article S to be produced. The cut sheets of the fiber article S are stacked on a tray 96. In this way, the fiber article producing apparatus 100 produces the fiber article S in the form of cut sheets.

Figure 2:
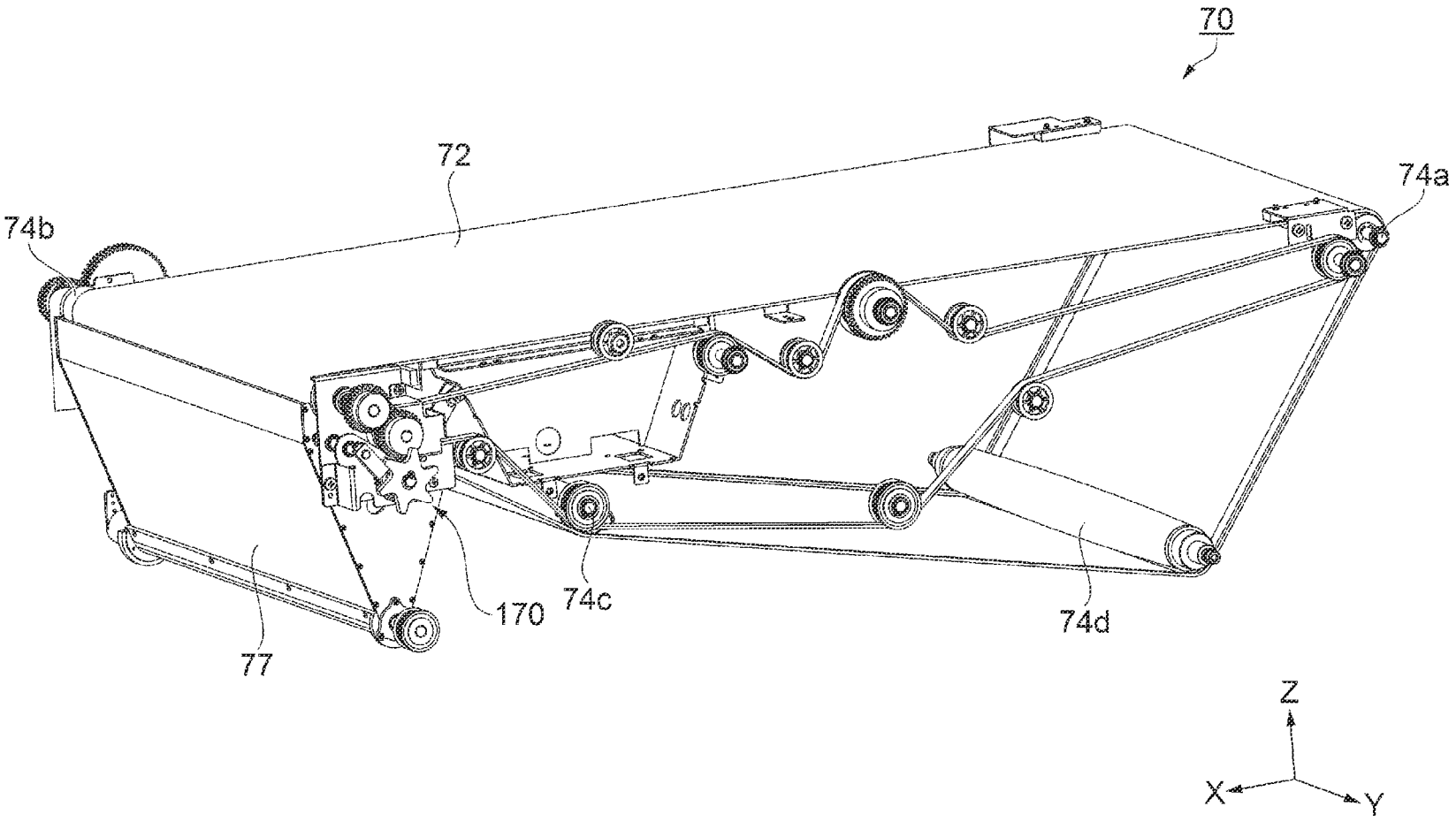
FIG. 2 is a perspective view illustrating a configuration of a web transportation apparatus.
Figure 3:
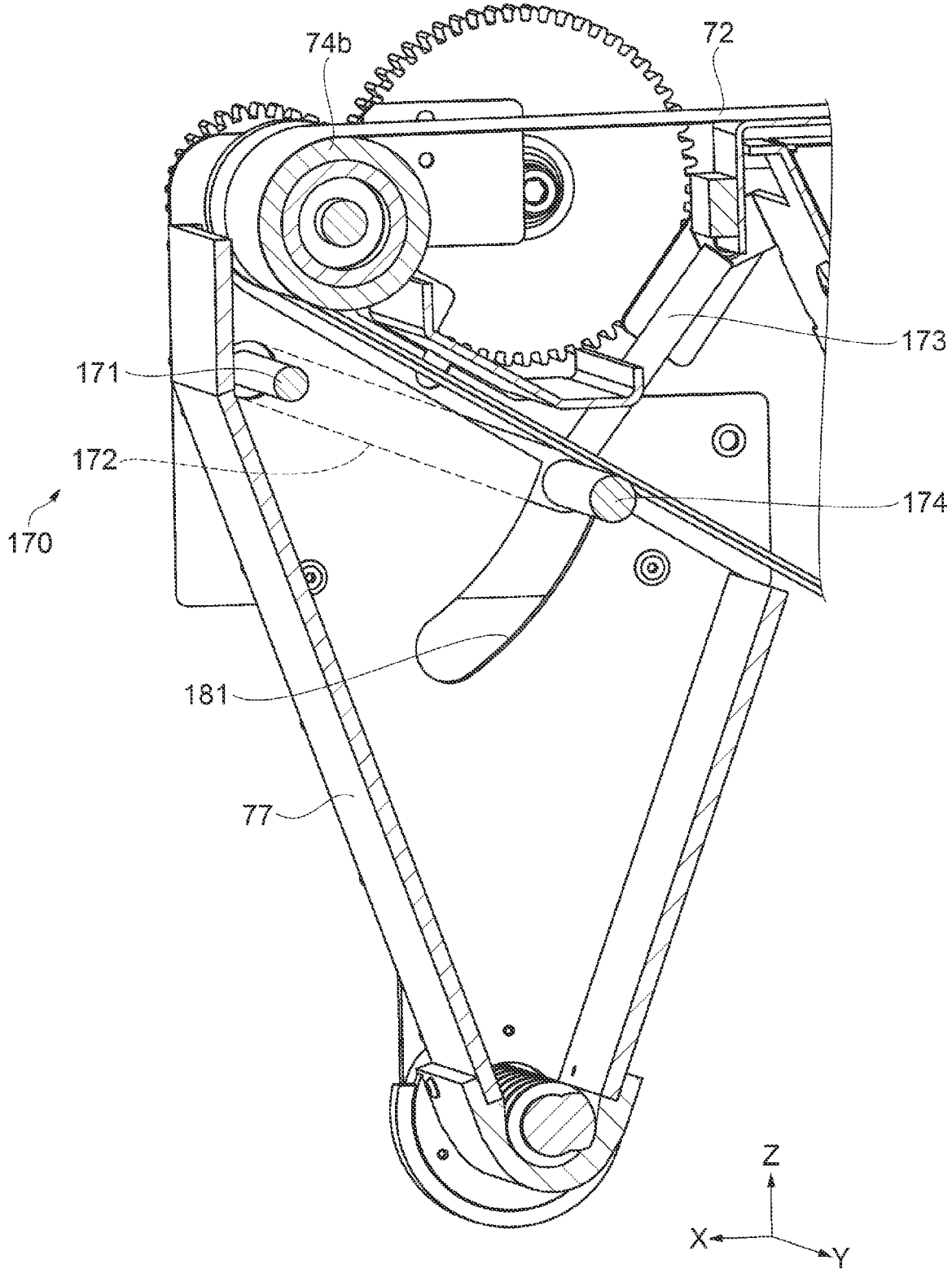
FIG. 3 is a magnified cross-sectional view illustrating a configuration of a striking member.
Figure 4:
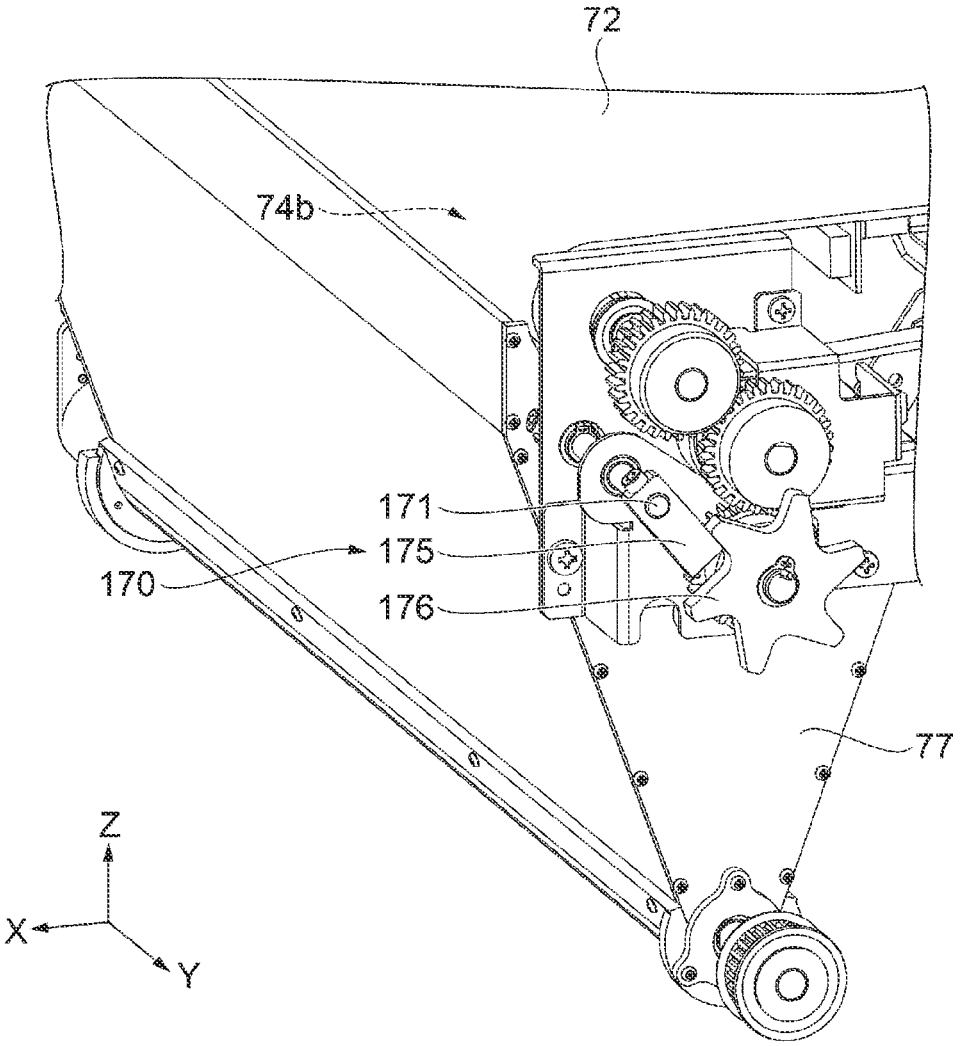
FIG. 4 is a magnified view illustrating a configuration of the striking member.

As illustrated in FIG. 2, in the web transportation apparatus 70, the striking member 170 and the collection portion 77 are located below the support roller 74*b*, which is the starting point of the return section of the mesh belt 72. In FIG. 2, and FIGS. 3 and 4 (described later), the components other than the web transportation apparatus 70 and the collection portion 77, and the suctioning mechanism 76 are not illustrated. Furthermore, FIG. 3 illustrates a cross section of the web transportation apparatus 70 taken along the XZ plane.

The mesh belt 72 allows the web W (not illustrated) to be formed on an upper surface of the transportation section extending from the support roller 74*a* to the support roller 74*b* and transports the web W. The mesh belt 72 is wound in a rectangular shape in side view in the −Y direction, and the outer surface of the rectangle is the transportation surface. The web W, which is a material of the fiber article S, is placed on the transportation section of the transportation surface of the mesh belt 72. Here, the length of the mesh belt 72 in the direction along the Y axis is referred to as the width of the mesh belt 72. The direction along the X axis of the mesh belt 72 is referred to as the lengthwise direction of the mesh belt 72 for descriptive purposes. The lengthwise direction of the mesh belt 72 corresponds to the rotation direction of the mesh belt 72.

The web W is transported from upstream to downstream from the −X direction to the +X direction. The web W is detached from the mesh belt 72 just before reaching the support roller 74*b* and transferred to the above-described conveyance unit 78. The mesh belt 72 is turned at the support roller 74*b* to the return section and rotated. Then, the mesh belt 72 is turned back at the support roller 74*a* to the transportation section via the support rollers 74*c* and 74*d*.

The mesh belt 72 turned back to the return section has a residue of the web W thereon in some cases. The residue attached to the mesh belt 72 may readily clog the holes of the mesh belt 72. When the web W is deposited again on the mesh belt 72 over the transportation section, the clogging prevents the suctioning mechanism 76 from suctioning. The insufficient suctioning lowers the quality of the fiber article S to be produced.

In response to the above issue, the web transportation apparatus 70 includes the striking member 170 to strike the mesh belt 72. This removes the residue of the web W from the mesh belt 72 and prevents clogging of the mesh belt 72.

As illustrated in FIGS. 3 and 4, the web transportation apparatus 70 includes the striking member 170 and the collection portion 77. The striking member 170 includes a shaft 171, a striking lever 172, a spring 173, one striking bar 174, an arm 175, and a gear 176. The collection portion 77 has a substantially triangular prism shape, and the height direction thereof extends along the Y axis. The side of the collection portion 77 facing the mesh belt 72 is not covered and is open.

As illustrated in FIG. 3, the striking bar 174 is a cylindrical rod. The longitudinal direction of the striking bar 174 extends along the Y axis. The longitudinal direction intersects the lengthwise direction of the mesh belt 72. The length of the striking bar 174 in the longitudinal direction is substantially equal to the width of the mesh belt 72. In FIG.

3, the striking bar 174 is positioned at a striking position where the striking bar 174 comes in contact with and strike the mesh belt 72.

The striking bar 174 and the mesh belt 72 are preferably formed of the same material. Specifically described, the striking bar 174 and the mesh belt 72 are formed of resin or metal, for example. This reduces the possibility that static electricity will be produced by contact between the striking bar 174 and the mesh belt 72. Thus, the striking bar 174 and the mesh belt 72 are less likely to be charged, preventing the material such as fibers from being attracted to them. This results in easy removal of the residue from the mesh belt 72. In this embodiment, the striking bar 174 and the mesh belt 72 are formed of polyester.

The striking bar 174 is fixed to one end of the striking lever 172 at an end in the −Y direction. The shaft 171 supports the other end of the striking lever 172. The striking lever 172 is rotatable about the shaft 171 along the XZ plane.

The collection portion 77 has a triangular prism shape. The striking lever 172 is adjacent in the −Y direction to the −Y direction side base of the triangular prism. The striking lever 172 is supported by the shaft 171 at a position away in the −Y direction from the −Y direction side base. The shaft 171 extends in the +Y direction and penetrates the bases of the triangular prism.

The striking bar 174 is pivotable about the shaft 171 while being supported by the striking lever 172. The rotation of the striking bar 174 is limited by the arm 175 and the gear 176 (described later) and reciprocated on an arc trajectory. The reciprocating striking bar 174 strikes the transportation surface of the return section of the mesh belt 72. This removes the residue of the web W, which is the material of the fiber article S attached to the mesh belt 72. Not only the residue of the web W but also the web W itself may be removed from the mesh belt 72 by the striking of the striking bar 174 for collection.

The striking bar 174 is supported by the striking lever 172 at a position away in the −Y direction from the −Y direction side base of the collection portion 77. Thus, the base of the collection portion 77 has a cutout 181 having a shape corresponding to the reciprocating motion of the striking bar 174. The mechanism of the reciprocating motion of the striking bar 174 will be described in detail later.

The spring 173 is attached to one end of the striking lever 172 to which the striking bar 174 is fixed. The spring 173 is attached to the striking lever 172 at one end and attached to a frame (not illustrated) of the web transportation apparatus 70 at the other end. The spring 173 is an extension coil spring and biases the striking bar 174 toward the mesh belt 72 for reciprocating motion of the striking bar 174. The elastic force of the spring 173 enables the striking bar 174 to strike the mesh belt 72.

The impact level of striking bar 174 against the mesh belt 72 is adjusted by changing the elastic force of the spring 173. The configuration that enables the striking action of the striking bar 174 is not limited to the above. The spring 173 may be an elastic member, such as a helical coil spring, a helical torsion spring, a flat spring, a spiral spring, a torsion bar, rubber, and the elastic member may be positioned depending on the biasing direction. The number of the spring 173 is not limited to one. Another spring 173 may be disposed on the +Y direction side base of the collection portion 77.

The striking action of the striking bar 174 against the transportation surface of the mesh belt 72 improves the ability to remove the residue of the web W from the mesh belt 72. Specifically described, when the mesh belt 72 is warped momentarily by the striking, the residue on the transportation surface is readily detached due to an inertial force of the residue to remain on the transportation surface of the mesh belt 72 and the impact of striking by the striking bar 174. Furthermore, when the mesh belt 72 is warped momentarily, the air near the rear surface opposite the transportation surface passes swiftly through the holes of the mesh belt 72. This accelerates the detachment of the residue from the mesh belt 72. These features improve the ability to remove the residue from the mesh belt 72.

The collection portion 77 collects the residue of the web W removed from the mesh belt 72 by using the striking bar 174. The collection portion 77 has a shape of a hopper having a diameter decreasing toward the lower side. The residue of the web W is collected into the collection portion 77 and then is gathered to the lower end of the collection portion 77. The collection portion 77 allows the residue of the material of the web W detached from the mesh belt 72 to be collected without being scattered.

As illustrated in FIG. 4, the arm 175 and the gear 176 are located outside the collection portion 77. Specifically described, the arm 175 and the gear 176 are adjacent in the +Y direction to the +Y direction side base of the triangular prism shaped collection portion 77. The arm 175 and the gear 176 constitute the mechanism for reciprocating the striking bar 174.

The arm 175 and the gear 176 are located to be in contact with each other. In plan view in the −Y direction, the arm 175 has a substantially rectangular shape, and the gear 176 has a substantially star polygon shape. Specifically described, the gear 176 has six convexes protruding radially and six concaves between the convexes. The convexes and the concaves of the gear 176 are alternately arranged.

The arm 175 is in contact with the gear 176 at one end and is supported by the +Y direction side end of the shaft 171 at the other end. In other words, as the above-described striking lever 172, the arm 175 is rotatable about the shaft 171.

When the arm 175 comes in contact with the gear 176 at one end, the arm 175 moves along the convexes and the concaves of the gear 176 and reciprocates in a clockwise direction and a counterclockwise direction. Specifically described, in plan view in the −Y direction, when the gear 176 is rotated in the counterclockwise direction, the arm 175 that is in contact with the concave moves over the convex in the clockwise direction. At this time, the striking bar 174 moves away from the mesh belt 72 against the biasing force of the spring 173.

Next, after the arm 175 moves over the convex, the arm 175 quickly moves in the counterclockwise direction by the biasing force of the spring 173 along the concave. At this time, the striking bar 174 strikes the mesh belt 72. Then, the arm 175 that is in contact with the concave again moves over the convex in the clockwise direction, and the striking bar 174 moves away from the mesh belt 72.

As described above, the arm 175 alternately comes in contact with the convexes and the concaves of the gear 176 and thus repeatedly moves in the clockwise direction and the counterclockwise direction. The motion of the arm 175 is transferred to the striking bar 174 through the shaft 171 and the striking lever 172. This enables the striking bar 174 to repeatedly strike and move away from the mesh belt 72.

The gear 176 is rotated by a drive motor (not illustrated) that drives the support roller 74. The cycle of striking action by the reciprocating motion of the striking bar 174 is suitably adjusted by changing the shape of the gear 176 or the arm 175 or changing the reduction ratio of the gear 176 to the drive motor.

When the striking bar 174 strikes the mesh belt 72, the impact of the striking acts over a region of the mesh belt 72 from a position near the support roller 74*b*, which is the starting point of the return section, to a position slightly downstream of the striking position of the striking bar 174. The impact of the striking by the striking bar 174 does not act on the section of the mesh belt 72 located upstream of the starting point of the return section but acts on the section of the mesh belt 72 located downstream of the starting point of the return section. In other words, the residue of the web W is removed by the impact over at least the region from the starting point to the striking position of the striking bar 174.

With this configuration, the residue of the web W attached to the mesh belt 72 is removed by the striking of the striking bar 174 at least over the region from the starting point to the striking position of the striking bar 174. The hopper of the collection portion 77 has a shape that covers an area including the above region.

Here, the striking position is a position where the mesh belt 72 and the striking bar 174 come in contact with each other. Although the striking bar 174 repeats striking every time at the same striking position, the position of the mesh belt 72 receiving the striking is changed due to the rotation of the mesh belt 72.

The striking bar 174 performs a first striking action against the mesh belt 72 and subsequently performs a second striking action against the mesh belt 72 that was rotated. A distance between the position of the first striking action and the position of the second striking action in the lengthwise direction of the mesh belt 72 is shorter than a distance between the starting point of the return section of the mesh belt 72 and the striking position of the striking bar 174.

The region of the mesh belt 72 positioned at the starting point during the first striking action is moved to a position between the starting point and the striking position of the striking bar 174 for the second striking action. In other words, the region of the mesh belt 72 positioned at the starting point during the first striking action is not moved downstream over the striking position of the striking bar 174 for the second striking action, which is performed after the first striking action. Thus, the region positioned at the starting point during the first striking action receives the impact of the second striking action before reaching the striking position of the striking bar 174.

Thus, the striking bar 174 strikes the region of the mesh belt 72 that received the impact at least one time. The striking bar 174 does not come in contact with the region that has the residue, reducing the possibility that the residue will attach to the striking bar 174. This further improves the ability to remove the residue of the web W. The striking bar 174 may perform the striking action two or more times until the region positioned at the starting point during the first striking action reaches the striking position of the striking bar 174.

The equation $L=V\times F$ is satisfied, in which an interval L (mm) is a distance between positions of the mesh belt 72 struck by striking bar 174, V (mm/sec) is a transportation speed of the mesh belt 72, and F (sec) is a cycle of the striking of the striking bar 174. As described above, the inequality $D>L$ is satisfied, in which D (mm) is a distance between the support roller 74*b* and the striking position of the striking bar 174 in the lengthwise direction of the mesh belt 72. The interval L corresponds to the distance between the position of the mesh belt 72 receiving the first striking action and the position of the mesh belt 72 receiving the second striking action.

Furthermore, the inequality $M>L$ is satisfied, in which M (mm) is a dimension of the opening of the collection portion 77 in the lengthwise direction of the mesh belt 72 along the mesh belt 72. This configuration allows the collection portion 77 to collect the residue of the web W detached from the mesh belt 72.

The entire length of the mesh belt 72 is not equal to an integral multiple of the interval L, which is the distance between the positions of the mesh belt 72 struck by the reciprocating striking bar 174. In other words, the entire length of the mesh belt 72 is not divided evenly by the interval L.

With this configuration, the striking positions against the mesh belt 72 are shifted in each cycle of the mesh belt 72, resulting in that different positions are struck. This accelerates removal of the residue of the web W from the mesh belt 72, further improving the removal ability.

The followings are advantages obtained by this embodiment. This embodiment has an improved ability to remove the residue of the web W containing fibers from the mesh belt 72. Specifically described, the residue attached to the mesh belt 72 is struck off from the mesh belt by the impact caused by the striking bar 174. The residue is not pushed out through the opening with a protrusion, such a brush, and thus materials containing fibers are unlikely to attach to the striking bar 174. In short, this embodiment provides the web transportation apparatus 70 that has an improvement in the ability to remove the residue of the web W from the mesh belt 72 and the fiber article producing apparatus 100.

2. Second Embodiment

A fiber article producing apparatus according to this embodiment differs from the fiber article producing apparatus 100 according to the first embodiment in the configuration and the position of the striking member of the web transportation apparatus. In the following description, the same reference numerals are assigned to the same components as those in the first embodiment without duplicated explanation.

Figure 5:
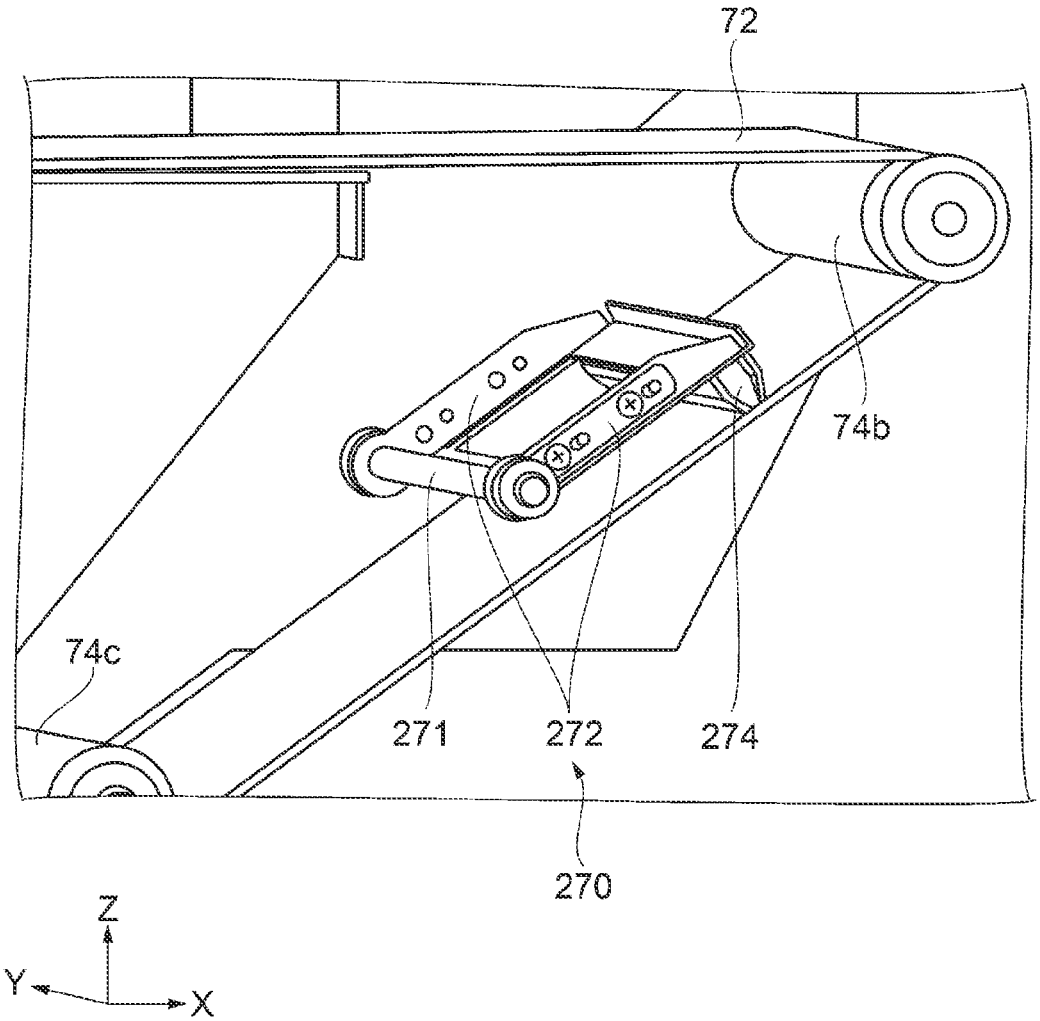
FIG. 5 is a perspective view illustrating a configuration of a striking member according to a second embodiment.

As illustrated in FIG. 5, the web transportation apparatus according to this embodiment includes a striking member 270. The striking member 270 includes a shaft 271, two striking levers 272, a striking bar 274, a spring (not illustrated), an arm, and a gear. In FIG. 5, only the mesh belt 72, the support rollers 74*b* and 74*c*, and the components of the striking member 270 described above are illustrated. In FIG. 5, the striking bar 274 is positioned at a striking position to strike the mesh belt 72.

In plan view in the +Y direction, the mesh belt 72 is wound in a rectangular shape, and the striking member 270 is located inside the rectangle. The striking bar 274 strikes the return section of the mesh belt 72 from the surface opposite the transportation surface on which the web W (not illustrated) is disposed, or the inner surface of the rectangle.

The two striking levers 272 are rotatably supported by the shaft 271 and rotated about the shaft 271 in side view in the +Y direction. One of the striking levers 272 is supported by a −Y direction side end portion of the shaft 271. The other of the striking levers 272 is supported by a +Y direction side end portion of the shaft 271.

The striking bar 274 has a cylindrical shape and a longitudinal direction thereof extends along the Y axis. The longitudinal direction intersects the lengthwise direction of the mesh belt 72. The length in the longitudinal direction of the striking bar 274 is substantially equal to the width of the mesh belt 72. The ends of the striking bar 274 are supported by the respective striking levers 272.

The striking bar 274 and the mesh belt 72 are preferably formed of the same material. In this embodiment, the striking bar 274 and the mesh belt 72 are formed of polyester.

The shaft 271 is biased by a spring to rotate in the clockwise direction in plan view in the +Y direction. The spring is repeatedly biased and unbiased toward the shaft 271 by the arm and the gear. The shaft 271 is repeatedly moved in the clockwise direction and the counterclockwise direction in side view in the +Y direction. With this configuration, the reciprocating motion of the striking bar 274 strikes the mesh belt 72.

In addition to the advantages of the first embodiment, the followings are advantages obtained by the second embodiment. The web transportation apparatus is readily downsized, since the striking member 270 is located on the rear side of the mesh belt 72 in side view in the +Y direction. Furthermore, replacement of the mesh belt 72 is easy, since contact between the striking member 270 and the mesh belt 72 is readily avoidable.

What is claimed is:

1. A web transportation apparatus comprising:

a mesh belt configured to be rotated to transport a web formed of a dry deposited material containing fibers; and a striking member arranged adjacent to a return section of the mesh belt, the striking member including a striking bar having an elongated shape extending substantially parallel to a surface of the mesh belt facing the striking bar and extending along a direction intersecting a transport direction of the mesh belt, and a striking lever fixed to the striking bar to reciprocate the striking bar along a direction intersecting the surface of the mesh belt facing the striking bar to strike the mesh belt to remove the material attached to the mesh belt.

2. The web transportation apparatus according to claim 1, wherein the striking bar is formed of a material identical to a material of the mesh belt.

3. The web transportation apparatus according to claim 1, wherein the striking bar strikes the mesh belt by using an elastic force.

4. The web transportation apparatus according to claim 1, further comprising a collection portion that collects the material detached from the mesh belt.

5. The web transportation apparatus according to claim 1, wherein the striking bar is configured to perform a first striking action on the mesh belt and subsequently perform a second striking action on the mesh belt that was rotated, and a distance between a position receiving the first striking action and a position receiving the second striking action in a lengthwise direction of the mesh belt is shorter than a distance between a starting point of the return section of the mesh belt and a striking position of the striking bar.

6. The web transportation apparatus according to claim 1, wherein the striking bar is configured to strike a transportation surface of the mesh belt on which the material is disposed.

7. The web transportation apparatus according to claim 1, wherein the striking bar is configured to strike a rear surface of the mesh belt opposite a transportation surface on which the material is disposed.

8. The web transportation apparatus according to claim 5, wherein an entire length of the mesh belt is not equal to an integral multiple of an interval that is the distance between the positions of the mesh belt struck by the reciprocating striking bar.

9. A fiber article producing apparatus comprising:

a deposition unit including a drum configured to dry deposit a material containing fibers;

a web transportation unit including a mesh belt on which the material is deposited from the deposition unit and configured to transport a web formed of the deposited material on the mesh belt; and a shaping unit including a pressing surface configured to press the web transferred from the mesh belt, wherein the web transportation unit includes a striking member arranged adjacent to a return section of the mesh belt, the striking member including a striking bar having an elongated shape extending substantially parallel to a surface of the mesh belt facing the striking bar and extending along a direction intersecting a transport direction of the mesh belt, and a striking lever fixed to the striking bar to reciprocate the striking bar along a direction intersecting the surface of the mesh belt facing the striking bar to strike the mesh belt to remove the material attached to the mesh belt.

* * * * *